US006909440B1

(12) United States Patent
Librandi et al.

(10) Patent No.: US 6,909,440 B1
(45) Date of Patent: Jun. 21, 2005

(54) STEPPED-DECAY VIDEO MORPHING FOR LIQUID CRYSTAL DISPLAYS

(75) Inventors: Richard N. Librandi, Elmont, NY (US); Richard F. Brofka, Syosset, NY (US); Gustav A. Anderson, Lake Ronkonkoma, NY (US); Eric O. Heinicke, East Northport, NY (US); Joseph L. Zelo, Nesconset, NY (US)

(73) Assignee: BAE SystemsInformation and Electronic Systems Integration Inc., Greenlawn, NY (US)

( * ) Notice: Subject to any disclaimer, the term of this patent is extended or adjusted under 35 U.S.C. 154(b) by 681 days.

(21) Appl. No.: 09/678,185

(22) Filed: Sep. 30, 2000

(51) Int. Cl.[7] ..... G09G 5/10
(52) U.S. Cl. ..... 345/690; 345/89; 345/691
(58) Field of Search ..... 345/87–89, 630, 345/419, 646, 690, 696, 98, 99, 100, 211; 382/118, 100, 274–275; 348/180, 143–153; 434/262

(56) References Cited

U.S. PATENT DOCUMENTS 5,111,195 A * 5/1992 Fukuoka et al. ..... 345/204
5,315,695 A * 5/1994 Saito et al. ..... 345/102
5,769,640 A * 6/1998 Jacobus et al. ..... 434/262
5,815,590 A * 9/1998 Buttner et al. ..... 382/103
6,072,496 A * 6/2000 Guenter et al. ..... 345/419
6,388,716 B1 * 5/2002 Tsuzuki et al. ..... 348/687
6,466,225 B1 * 10/2002 Larkin et al. ..... 345/596

FOREIGN PATENT DOCUMENTS

EP 0951007 10/1999 ..... G09G/3/36

* cited by examiner

*Primary Examiner*—Xiao Wu
(74) *Attorney, Agent, or Firm*—Kenneth P. Robinson

(57) ABSTRACT

An LCD display has disparate turn-on/turn-off characteristics whereby a rapid decrease in signal intensity at pixel positions can cause a flash effect. Such effect is avoided or reduced for a video signal including a large intensity decrease between successive images. By incrementally decreasing the signal intensity over three frames, rather than from one frame to the next, intermediate intensity steps reduce the frame-to-frame magnitude of intensity decrease. A key feature is selection of the size of the intermediate intensity step changes on a closed loop basis, by an operator viewing the image effects resulting from the operator's adjustments. Flash effects in particular applications may be affected by image content, incident light and other local conditions as well as by subjective viewer characteristics and preferences. By operator adjustment, while viewing the resulting display, the best presentation can be provided. The operator can also select the number of steps over which an intensity decrease is incrementally introduced.

23 Claims, 2 Drawing Sheets

STEPPED-DECAY VIDEO MORPHING FOR LIQUID CRYSTAL DISPLAYS

RELATED INVENTIONS (Not Applicable)

FEDERALLY SPONSORED RESEARCH (Not Applicable)

BACKGROUND OF THE INVENTION

This invention relates to displays subject to visual anomalies resulting from differences in the time required to increase and decrease light output for individual pixel positions and, more particularly, to compensation for such anomalies in operation of liquid crystal and other displays.

A liquid crystal display (LCD) in a flat display format capable of displaying monochromatic, partial color, or full color images can be utilized in a variety of applications. Cathode ray tube (CRT) type displays provide images with pixel luminance responses capable of tracking rapid frame-to-frame changes in signal intensity of a video signal. However, that is typically not true for an LCD. Depending on the specifics of particular LCD constructions, configurations and excitation conditions, the luminance response of an LCD may be characterized by a disparity between luminance rise time, as compared to luminance decay time. Thus, there are typically measurably different time durations for switching an LCD pixel from a high intensity light output condition to a low intensity output condition, as compared to switching from low to high light output. The LCD faster video turn-off time, relative to turn-on time, results in the appearance of an "off flash" in many instances when an image is updated or moved on the display, or both moved and updated. This anomaly, which can both distract the viewer and make observation of displayed effects or data more difficult, may also be referred to as a blink anomaly. The effect may be more or less pronounced or distracting depending upon the particular type of image displayed, data content, ambient light, particular LCD construction, equipment set up, operating environment, etc., as well as differences and variations in perception and visual response of a particular viewer and from viewer to viewer.

Subsequent to their invention, the present inventors became aware of the existence of European Patent Application No. 0951007. This application discusses LCD luminance rise and decay differences and describes an approach applying complex equations to slow down a faster response over consecutive correction periods to match rising luminance to the reverse of a curve representing decaying luminance. This prior approach also provides for use of input data representing current temperature and pixel location, in attempting to determine appropriate rise/decay compensation action automatically, without operator participation. As such, this prior approach is seen as inadequate to be fully responsive to anomalies actually experienced by a particular viewer under varying operating conditions, as well as to visual response and actual perception of a viewer.

Objects of the present invention are, therefore, to provide new and improved stepped-decay video morphing methods and such methods having one or more of the following characteristics and capabilities:

- customized morphing characteristics selectable by an operator while viewing screen anomalies under current actual operating conditions;

- operator-optimized stepped-decay of signal intensity from a prior image to a new image;
- stepped-decay video morphing with operator-adjustable interim intensity steps between old and new pixel intensities;
- stepped-decay video morphing with operator selection of step magnitude and number of steps while viewing resulting display;
- stepped-decay video morphing with fixed magnitude default step size in absence of operator selection; and
- stepped-decay video morphing with fixed number of fixed magnitude default steps in absence of operator selection.

SUMMARY OF THE INVENTION

In accordance with the invention, a stepped-decay video morphing method, to modify video signals for use with a display having disparate turn-on/turn-off characteristics, comprises the following steps:

(a) for a first pixel position, comparing the signal intensity for a new image (termed "NEW" pixel intensity) to the signal intensity for a prior image (termed "OLD" pixel intensity);

(b) for a NEW pixel intensity within an intensity range from equal to, to greater than, the OLD pixel intensity, changing the signal intensity for the first pixel position to the NEW pixel intensity;

(c) for a NEW pixel intensity below the intensity range specified in step (b), incrementally decreasing the signal intensity for the first pixel position to a first intermediate intensity between the OLD and NEW pixel intensities, with the first intermediate intensity selectable by an operator viewing the display; and (d) decreasing the signal intensity for the first pixel position from an intermediate intensity to the NEW pixel intensity.

For a three step morphing method, the above method may include the following additional step between steps (c) and (d);

(x) following the incremental decrease in step (c), incrementally decreasing the signal intensity for the first pixel position from the first intermediate intensity to a second intermediate intensity between the first intermediate intensity and the NEW pixel intensity, with the second intermediate intensity selected by operator adjustment.

In application of the above method, video signals are typically provided to said display on a frame-by-frame basis, with a new image introduced only every four frames, and steps (c), (x) and (d) are implemented for successive frames. Also, to address the totality of pixels of a display, steps (a) through (d) are repeated for a second and subsequent pixel positions in time periods which overlap the time period for the initial performance of steps (a) through (d).

Further in accordance with the invention, a stepped-decay video morphing system, to modify video signals for use with a display having disparate turn-on/turn-off characteristics, comprises a comparator, a memory and a processor. The comparator is arranged to compare for a first pixel position the signal intensity for a new image (termed "NEW" pixel intensity) to the signal intensity for a prior image (termed "OLD" pixel intensity). The memory is coupled to the comparator to store data representative of OLD pixel intensity for the first pixel position, and an associated frame flag identifying a frame of the video signals. The processor, coupled to the comparator and the memory and responsive to the frame flag, is arranged to:

(i) for a NEW pixel intensity within an intensity range from equal to, to greater than, the OLD pixel intensity, change the signal intensity for the first pixel position to the NEW pixel intensity;

(ii) for a NEW pixel intensity below the defined intensity range, incrementally decrease the signal intensity for the first pixel position to a first intermediate intensity between the OLD and NEW signal intensities, with the first signal intensity selectable by adjustment by an operator able to view the display;

(iii) after the incremental decrease of signal intensity to the first intermediate intensity, incrementally decrease the signal intensity for the first pixel position from the first intermediate intensity to a second intermediate intensity between the first intermediate intensity and the NEW pixel intensity, with the second signal intensity selectable by adjustment by an operator able to view the display; and (iv) after the intermediate signal decreases, decrease the signal intensity for the first pixel position to the NEW pixel intensity.

For a better understanding of the invention, together with other and further objects, reference is made to the accompanying drawings and the scope of the invention will be pointed out in the accompanying claims.

DESCRIPTION OF THE INVENTION

Figure 1:
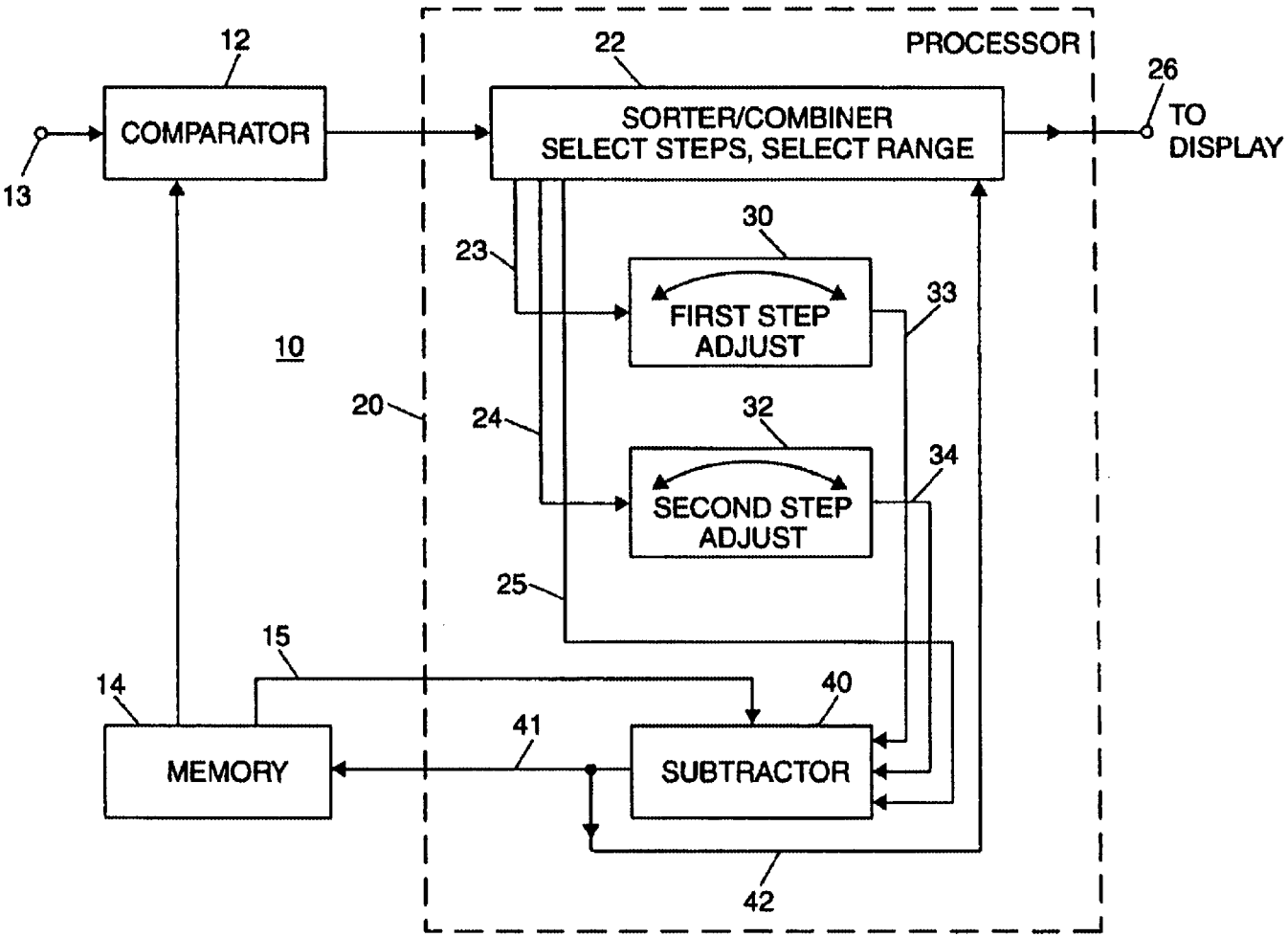
FIG. 1 illustrates an embodiment of a stepped-decay video morphing system utilizing the invention.

FIG. 1 illustrates an embodiment of a stepped-decay video morphing system 10, to modify video signals for use with a display (such as an LCD display) having disparate turn-on/turn-off characteristics. These characteristics may be represented by a faster turn-off time for a particular pixel position to transition from high intensity light output to low intensity light output, relative to a slower turn-on time to transition from low intensity to high intensity, for example. As shown, system 10 includes a comparator 12 to compare, on a pixel-by-pixel basis, signal intensity for a new image to signal intensity for a prior image. This is typically carried out on a frame-by-frame basis, even though image content may change less rapidly (e.g., a new image every four frames). More particularly, comparator 12 is arranged to compare, for a first pixel position, the signal intensity for a new image (termed "NEW" pixel intensity) to the signal intensity for a prior image (termed "OLD" pixel intensity). Thus, the OLD pixel intensity may be representative of either a new image as previously received, or such previously received image as processed on an intermediate frame-by-frame basis pursuant to the invention, as will be described.

Operationally, in this embodiment comparator 12 receives new image video, via input 13, and previously processed data representative of pixel intensity values in prior image video, from storage in memory 14. Unit 12 operates to subtract the prior image pixel intensity values from the values for the new image video to provide pixel-by-pixel values representative of the difference in signal intensity for respective pixel positions (e.g., differences in luminance values). The signal at the output of comparator 12 is thus representative of the magnitude and sign (i.e., + or −) of the difference between the NEW pixel intensity and OLD pixel intensity, on a pixel-by-pixel basis. Attention will be directed primarily to a single pixel position (i.e., the first pixel position) which may be any pixel position, with the first pixel position being representative of processing of all or a plurality of pixel positions on a pixel-by-pixel basis. Such processing may be implemented basically in series (e.g., for pixels of a monochrome display) or in series/parallel (e.g., in series for pixels, with parallel or independent processing for the three colors of a color display).

The FIG. 1 system includes a memory 14 arranged to store signals representative of the OLD pixel intensity values, representing decreases in intensity levels in video signals as received for the preceding frame and subsequently processed pursuant to the invention, as will be described. By connection to comparator 12, the memory 14 thus supplies data representative of OLD pixel intensities for the prior image, for comparison to the NEW pixel intensities for the new image within comparator 12.

The FIG. 1 system to modify video signals for use with a display having disparate turn-on/turn-off characteristics further includes processor 20, coupled to comparator 12 and memory 14. As will be described in greater detail, considered with respect to the signal intensity for the first pixel position, processor 20 is effective to either:

(A) for a NEW pixel intensity within an intensity range from equal to, to greater than, the OLD pixel intensity, change the signal intensity directly to the NEW pixel intensity, or (B) for a NEW pixel intensity below that defined intensity range, first, incrementally decrease the signal intensity for the first pixel position to a first intermediate step intensity between the OLD and NEW pixel intensities, with such first intermediate step intensity selected by an operator while viewing the LCD display, and second, further incrementally decrease the signal intensity for the first pixel position to a second intermediate step intensity between the first intermediate step intensity and the NEW pixel intensity, by operator selection while viewing the display, and third, decrease the signal intensity for the first pixel position from the final intermediate stepped signal intensity to the NEW pixel intensity.

The system thereby changes the pixel intensity directly from the OLD (prior image intensity) to the NEW (new image) intensity, if the NEW intensity equals or exceeds the OLD intensity. However, if the NEW intensity is less than the OLD intensity, the NEW intensity is implemented for the first pixel position on an incrementally stepped basis over three frames of the video signal. Every additional pixel position is treated in the same manner, typically on a serial basis for a monochrome image and on a serial/parallel basis for three colors of a full color image with pixel values for each color independently processed in parallel time periods.

An important feature of the present invention is a "closed loop" capability whereby the operator adjusts operating parameters by selection of the magnitude of the incremental decrease steps, while viewing the visual effects of such adjustments. Thus, regardless of the degree of analysis and automatic control which it might be possible to implement, there would still be ambient, data/image specific, and operator subjective effects and influences which affect operator/viewer ease of viewing and comprehension of the displayed image. Pursuant to the invention, the operator views the display and selects the step intensity for best presentation at a point in time, and from time to time. As will be further discussed, the operator may also be enabled to select between a two step intensity decrease over two frames and a three step decrease of over three frames, as discussed above. Also, while subparagraph (A) above was applicable to a range "from equal to, to greater than" the OLD pixel intensity, provision may be made for changing or adjusting that range. For example, a negative threshold may be included so that an intensity change directly from OLD to NEW is implemented for any NEW pixel intensity in a range "from a predetermined threshold below, to greater than" the OLD pixel intensity, for example. This recognizes that for a small decrease in signal intensity the flash effect may be minimal, so that a stepped response is not called for unless the negative change exceeds a threshold magnitude. Thus, a threshold for this purpose can be set to encompass an intensity change of about twenty percent of a maximum decrease in signal intensity, for example.

Considering the illustrated embodiment of processor 20 in FIG. 1, a representation of a NEW pixel intensity for a first (representative) pixel position is input to processor 20 from comparator 12. This input represents a positive intensity value or, for an intensity decrease, the magnitude of the difference between the NEW pixel intensity and the OLD pixel intensity, for the first pixel position. Operationally, under control of unit 22, a negative signal (representing an intensity decrease for the first pixel position) is coupled to one of paths 23, 24, 25 for processing to implement an incremental stepped decrease. However, a positive or zero magnitude signal is coupled through to port 26 without comparable modification, although suitable delay or other adjustment may be provided as appropriate.

Thus, a signal representing a NEW pixel intensity within an intensity range from equal to, to greater than, the OLD pixel intensity is effectively passed through to port 26. However a signal representing a NEW pixel intensity below that intensity range is coupled to one of paths 23, 24, 25 for processing. As noted, the intensity range may be changed to a different range (e.g., a range subject to a threshold) so that a signal of only a small negative magnitude (representing a small intensity decrease) need not be processed and is passed through to port 26.

A negative signal selected for processing is coupled to one of paths 23, 24, 25. Assume that an image is not changed or updated more frequently than every four frames and that the operator has selected three step processing. When a negative signal representing an intensity decrease for the first pixel position is first received and selected for processing (i.e., in the first frame for a new image) it is coupled to path 23. Such signal may be termed a "delta signal" since it represents the difference between NEW and OLD pixel intensities. At 30, the amplitude of the delta signal is decreased by an operator adjustment made while viewing a display presenting an image from processed video signals provided at port 26. Typically, the operator may select to reduce the delta signal amplitude (in first step adjust unit 30) so that its amplitude at output path 33 will be equal to from 0 to 100 percent of its path 23 input amplitude, with a default setting of nominally 67 percent. With the default setting as an example, the reduced delta signal for the first pixel position is coupled to subtractor 40. Memory 14 is an enhanced frame memory adequate to store processed delta signals received via path 41 from subtractor 40 and also associated frame flags produced by processor 20 to identify the relative frame number which particular delta signals represent. With operator selection of three step processing as noted above, the first iteration of processed delta signals will be flagged as representing frame 1, the second iteration using frame 2 flags and the third iteration identified by frame 3 flags.

Thus, subtractor unit 40 receives the first frame delta signal for the first pixel position via path 33, after the signal has been reduced to 67 percent of its original magnitude. Subtractor 40 also receives from memory 14, via path 15, a processed delta signal representing the first pixel position pixel intensity in the preceding frame (e.g., bearing a 3 flag of the preceding image). By combining these inputs, at path 41 there is provided a processed delta signal representing a decrease in the signal intensity for the first pixel position of a magnitude equal to 33 percent of the difference between the OLD and NEW pixel intensities. This processed delta signal is stored in memory 14 with an associated frame 1 flag and also provided to sorter/combiner 22, via path 42. In unit 22, the processed delta signal is used to provide to the display, via output port 26, a first step intensity signal representing an incremental decrease in the excitation intensity at the first pixel position from the OLD pixel intensity to a first step intensity representing a decrease of 33 percent of the OLD to NEW intensity decrease. Thus, rather than changing directly from the OLD to the NEW decreased intensity, a one-third decrease is implemented to reduce or eliminate flash effects.

For frame 2 of the present new image cycle, the same "new" video signal is assumed to be input to processor 20 via input port 13. With the pixel intensity for the first pixel position now flagged for frame 2, the negative delta signal (now only ⅔ of its first frame magnitude) is coupled to second step adjust unit 32, via path 24. Again, adjustment by operator/viewer selection typically enables reduction of the pixel intensity by reduction of the delta signal by 0 to 100 percent (e.g., in one percent steps), with a default setting to provide nominally a delta signal reduction of 67 percent. As described for the frame 1 delta signal, assuming a 50 percent reduction by unit 32, for example, a second step intensity reduction from 33 percent of the OLD to NEW intensity difference as provided in frame 1, to 67 percent of the OLD to NEW difference (50 percent of the difference between 33 percent and 100 percent) is implemented for frame 2. Finally, for frame 3 the same "new" video signal is assumed to be coupled to processor 20 via input port 13. With the pixel intensity for the first pixel position now flagged for frame 3, the negative delta signal (now only ⅓ of its first frame magnitude) is coupled, via path 25, directly to subtractor unit 40. Now, the resulting processed delta signal, as coupled via path 42 to unit 22 and provided at output port 26, represents the full NEW pixel intensity for the first pixel position.

As described, the signal intensity for the first pixel position is incrementally decreased from the OLD pixel intensity to the NEW pixel intensity in three steps, thereby decreasing the potential for flash effect associated with large decreases in frame-to-frame excitation of an LCD display. Pursuant to the invention, the operator/viewer selects the relative step sizes for optimum display presentation and may, for example, disable use of the second step adjust unit 32 in order to provide two step video decay when adequate for desired display presentation. The operator may further be enabled to disable both step adjust units 30 and 32 to provide full flexibility of operation under all potential operating conditions. As noted, step sizes may be set at respective negative default values of 33 and 67 percent, for example, in the absence of operator adjustment. As used herein, "nominally" is defined as encompassing values within a range of plus or minus 15 percent of a stated value.

Figure 2:
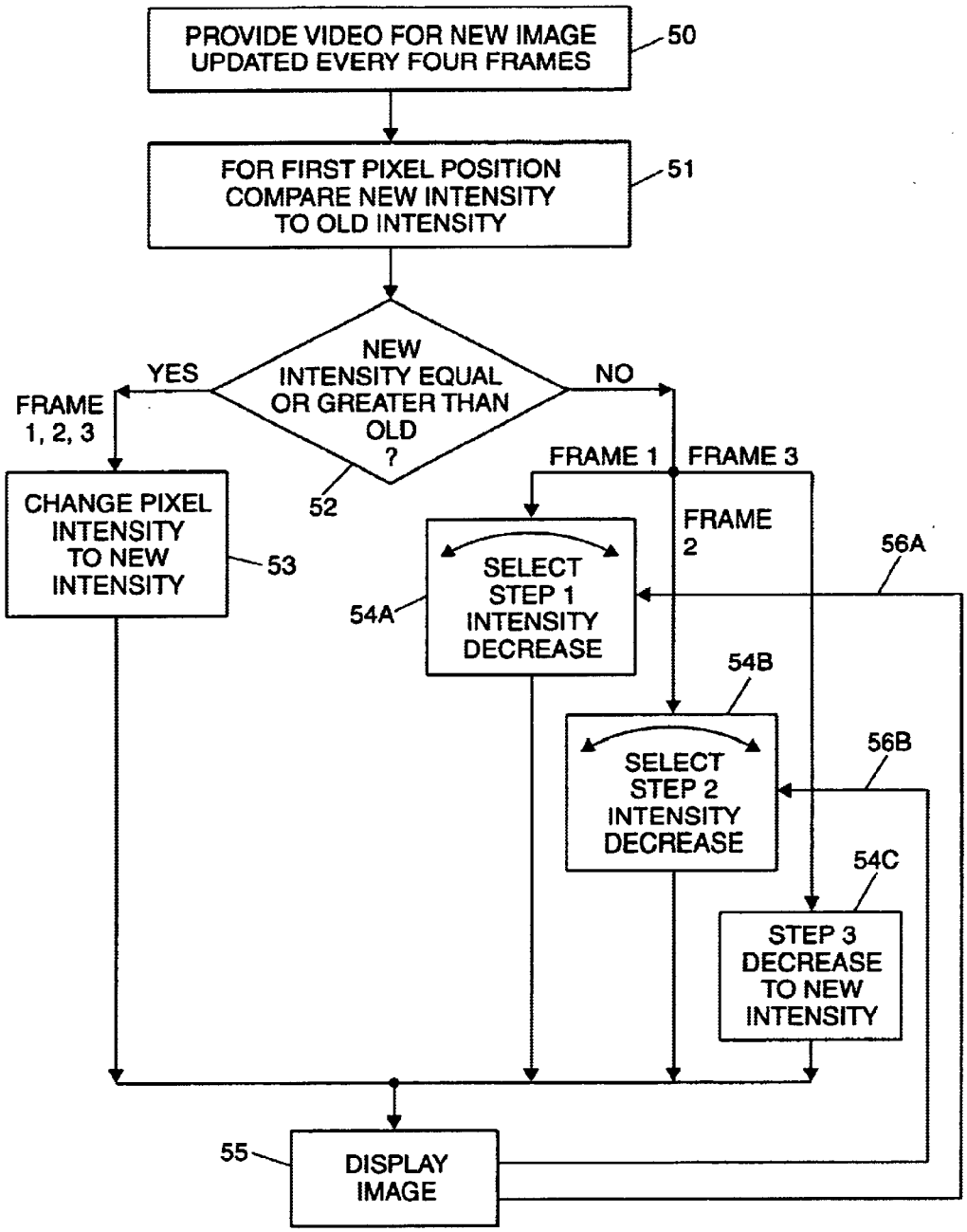
FIG. 2 is a flow chart useful in describing a stepped-decay video morphing method utilizing the invention.

Referring now to FIG. 2, there is illustrated a flow chart useful in describing a method in accordance with the invention.

At 50, a video input is provided for all pixel positions of a new image. For the present example, video is provided on a frame by frame basis with changes in video content introduced every fourth frame.

At 51, for a first pixel position the signal intensity for a new image (termed "NEW" pixel intensity) is compared to the signal intensity for a prior image (termed "OLD" pixel intensity). As described above; in the FIG. 1 embodiment stored processed delta signals for the preceding frame are subtracted from incoming video for a new image in comparator 12.

At 52, a NEW pixel intensity which is in a range from equal to, to greater than, the OLD pixel intensity is coupled to the "YES" branch. A NEW pixel intensity which does not fall within that range (i.e., a negative intensity) is coupled to the "NO" branch.

At 53, if the NEW pixel intensity is within the defined range, the signal intensity for the first pixel position is changed directly to the NEW pixel intensity and used for image display at 55.

At 54A, if the NEW pixel intensity is not within the defined range, for the first frame the signal intensity is incrementally decreased to a first intermediate step intensity between the OLD and NEW intensities. The actual step intensity is selected by the operator, on a closed-loop feedback basis via path 56A, while viewing the display and selecting the step intensity on a best visual presentation basis. Thus, for example, one-third of total intensity decrease between the OLD and NEW pixel intensities may be implemented at this point.

At 54B, action as described at 54A above is iterated for the second frame, with the signal intensity for the first pixel position incrementally decreased to a second intermediate step intensity between the first step intensity and the NEW pixel intensity. Operator/viewer intensity adjustment is implemented on a closed loop basis via path 56B. Thus, for example, two-thirds of the total intensity decrease between the OLD and NEW pixel intensities may be implemented at this point.

At 54C, in this example two-thirds of the total intensity decrease for the first pixel position will already have been implemented at 54A and 54B above. At 54C the NEW pixel intensity is passed directly, without magnitude adjustment, for image display at 55.

At 55, successive image frames are displayed, with the image intensity for the first pixel position directly changed for signal intensity increase between the old and new images. For decreased intensity, the NEW image intensity for the first pixel position is introduced on an incremental three step basis over three successive frames.

The above discussion addresses only implementation of an intensity change for one pixel position from an old image to a new image. On a complete image basis, all pixel positions of the first frame are implemented as above, in series with the first pixel position (e.g., in series for each frame, but in overlapping time periods over the duration of three frames). Similarly, for the second and third frames, all pixel positions are processed on a series basis. For the three individual color signal components of full color video, the method of FIG. 2 is implemented independently, but in parallel time periods for each color component so that all three processed color signals can arrive in synchronism at 55 for display of color images.

The illustrated embodiment of processor 20 is shown conceptually as including discrete sub-units for purposes of ease of description of operation. In application of the invention, the described operation may be implemented by skilled persons in different forms utilizing discrete elements, appropriate programming of a microprocessor, a combination thereof, or as otherwise suitable in particular applications.

While there have been described the currently preferred embodiments of the invention, those skilled in the art will recognize that other and further modifications may be made without departing from the invention and it is intended to claim all modifications and variations as fall within the scope of the invention.

What is claimed is:

1. A stepped-decay video morphing method, to modify video signals for use with a display having disparate turn-on/turn-off characteristics, comprising the following steps:

(a) for a first pixel position, comparing the signal intensity for a new image (termed "NEW" pixel intensity) to the signal intensity for a prior image (termed "OLD" pixel intensity);

(b) for a NEW pixel intensity within an intensity range from equal to, to greater than, the OLD pixel intensity, changing the signal intensity for the first pixel position to said NEW pixel intensity;

(c) for a NEW pixel intensity below the intensity range specified in step (b), incrementally decreasing the signal intensity for the first pixel position to a first intermediate intensity between the OLD and NEW pixel intensities, said first intermediate intensity selectable by an operator viewing said display; and (d) decreasing the signal intensity for the first pixel position from an intermediate intensity to the NEW pixel intensity.

2. A stepped-decay video morphing method as in claim 1, including the following additional step between steps (c) and (d):

(x) following said incremental decrease in step (c), incrementally decreasing the signal intensity for the first pixel position from the first intermediate intensity to a second intermediate intensity between the first intermediate intensity and the NEW pixel intensity, said second intermediate intensity selected by operator adjustment.

3. A stepped-decay video morphing method as in claim 1, wherein video signals are provided to said display on a frame-by-frame basis and steps (c) and (d) are implemented for successive frames.

4. A stepped-decay video morphing method as in claim 1, wherein step (c) includes selecting said first intermediate intensity by an operator viewing said display.

5. A stepped-decay video morphing method as in claim 1, wherein steps (a) through (d) are repeated for a second and subsequent pixel positions in time periods which overlap the time period for the initial performance of steps (a) through (d).

6. A stepped-decay video morphing method as in claim 1, wherein signal intensity represents one of video signal amplitude and image luminance.

7. A stepped-decay video morphing method as in claim 1, wherein the video signals represent a color image and, for said first pixel position, steps (a) through (d) are performed independently for each of red, green and blue component signals.

8. A stepped-decay video morphing method as in claim 1, wherein the intensity range specified in step (b) is changed to the following intensity range: from a predetermined threshold below, to greater than, the OLD pixel intensity.

9. A stepped-decay video morphing method, to modify video signals for use with a display having disparate turn-on/turn-off characteristics, comprising the following steps:

(a) for a first pixel position, comparing the signal intensity for a new image (termed "NEW" pixel intensity) to the signal intensity for a prior image (termed "OLD" pixel intensity);

(b) for a NEW pixel intensity within an intensity range from equal to, to greater than, the OLD pixel intensity, changing the signal intensity for the first pixel position to said NEW pixel intensity;

(c) for a NEW pixel intensity below the intensity range specified in step (b), incrementally decreasing the signal intensity for the first pixel position to a predetermined first intermediate intensity between the OLD and NEW pixel intensities; and (d) decreasing the signal intensity for the first pixel position from an intermediate intensity to the NEW pixel intensity.

10. A stepped-decay video morphing method as in claim 9, wherein said first intermediate intensity nominally equals said OLD pixel intensity, less one-half of the difference between said OLD and NEW pixel intensities.

11. A stepped-decay video morphing method as in claim 9, including the following additional step between steps (c) and (d):

(x) following said incremental decrease in step (c), incrementally decreasing the signal intensity for the first pixel position from the first intermediate intensity to a predetermined second intermediate intensity between the first intermediate intensity and the NEW pixel intensity.

12. A stepped-decay video morphing method as in claim 11, wherein said first intermediate intensity nominally equals said OLD pixel intensity, less one-third of the difference between said OLD and NEW pixel intensities, and said second intermediate intensity nominally equals said OLD pixel intensity, less two-thirds of the difference between said OLD and NEW pixel intensities.

13. A stepped-decay video morphing method as in claim 9, wherein the video signals represent a color image and, for said first pixel position, steps (a) through (d) are performed independently for each of red, green and blue component signals.

14. A stepped-decay video morphing method as in claim 9, wherein the intensity range specified in step (b) is changed to the following intensity range: from a predetermined threshold below, to greater than, the OLD pixel intensity.

15. A stepped-change video morphing method, to modify video signals for use with a display having disparate turn-on/turn-off characteristics, comprising the following steps:

(a) for a first pixel position, comparing the signal intensity for a new image (termed "NEW" pixel intensity) to the signal intensity for a prior image (termed "OLD" pixel intensity);

(b) for a NEW pixel intensity which differs from the OLD pixel intensity by an intensity difference of predetermined sign and of at least a predetermined magnitude, incrementally changing the signal intensity for the first pixel position to a first intermediate intensity between the preceding signal intensity for said first pixel position and said NEW pixel intensity, said first intermediate intensity selectable by an operator viewing said display; and (c) after signal intensity is changed pursuant to step (b), changing the signal intensity for the first pixel position to said NEW pixel intensity.

16. A stepped-change video morphing method as in claim 15, wherein step (b) includes selecting said first intermediate intensity by an operator viewing said display.

17. A stepped-change video morphing method as in claim 15, additionally comprising repeating step (b) at least once by operator selection based on viewing said display.

18. A stepped-change video morphing method as in claim 15, wherein video signals are provided to said display on a frame-by-frame basis and steps (b) and (c) are implemented for successive frames.

19. A stepped-change video morphing method as in claim 15, including the following additional step:

(d) if signal intensity is not changed pursuant to step (b), changing the signal intensity for the first pixel position directly to said NEW pixel intensity.

20. A stepped-decay video morphing system, to modify video signals for use with a display having disparate turn-on/turn-off characteristics, comprising:

a comparator to compare for a first pixel position the signal intensity for a new image (termed "NEW" pixel intensity) to the signal intensity for a prior image (termed "OLD" pixel intensity);

a memory coupled to the comparator to store data representative of OLD pixel intensity for the first pixel position, and an associated frame flag identifying a frame of said video signals; and a processor, coupled to the comparator and the memory and responsive to said frame flag, to (i) for a NEW pixel intensity within an intensity range from equal to, to greater than, the OLD pixel intensity, change the signal intensity for the first pixel position to said NEW pixel intensity;

(ii) for a NEW pixel intensity below said intensity range, incrementally decrease the signal intensity for the first pixel position to a first intermediate intensity between the OLD and NEW signal intensities, said first signal intensity selectable by adjustment by an operator able to view said display; and (iii) after an intermediate signal decrease, decrease the signal intensity for the first pixel position to the NEW pixel intensity.

21. A stepped-decay video morphing system as in claim 20, wherein said processor is further arranged, between said incremental decreases of signal intensity to the first intermediate intensity and to the NEW pixel intensity, to:

incrementally decrease the signal intensity for the first pixel position from the first intermediate intensity to a second intermediate intensity between the first intermediate intensity and the NEW pixel intensity, said second signal intensity selectable by adjustment by an operator able to view said display.

22. A stepped-decay video morphing system as in claim 20, wherein the processor is arranged to implement the successive decreases of signal intensity to the first and NEW intensities for successive frames of said video signals.

23. A stepped-decay video morphing system as in claim 20, wherein said intensity range is changed to the following intensity range: from a predetermined threshold below, to a greater than, the OLD pixel intensity.

* * * * *